US009118130B1

(12) United States Patent
Volpone et al.

(10) Patent No.: US 9,118,130 B1
(45) Date of Patent: Aug. 25, 2015

(54) LOW INSERTION FORCE TERMINAL

(71) Applicant: DELPHI TECHNOLOGIES, INC., Troy, MI (US)

(72) Inventors: Thomas Andrew Volpone, Cortland, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/174,157

(22) Filed: Feb. 6, 2014

(51) Int. Cl.
*H01R 13/11* (2006.01)

(52) U.S. Cl.
CPC ..... *H01R 13/113* (2013.01)

(58) Field of Classification Search
CPC ..... H01R 13/113; H01R 13/114
USPC ..... 439/852–854, 857, 858
See application file for complete search history.

(56) References Cited

U.S. PATENT DOCUMENTS

| | | | | |
|---|---|---|---|---|
| 5,540,603 | A * | 7/1996 | Fujiwara | 439/851 |
| 5,630,738 | A * | 5/1997 | Ito et al. | 439/852 |
| 5,707,259 | A * | 1/1998 | Ishizuka et al. | 439/852 |
| 5,839,925 | A * | 11/1998 | Simmons | 439/852 |
| 6,478,636 | B1 * | 11/2002 | Makita et al. | 439/852 |
| 6,506,084 | B2 * | 1/2003 | Saitoh | 439/852 |
| 7,156,704 | B2 * | 1/2007 | Shimizu | 439/852 |
| 7,189,124 | B2 * | 3/2007 | Kobayashi et al. | 439/852 |
| 7,204,728 | B2 * | 4/2007 | Noro et al. | 439/852 |
| 7,223,135 | B2 * | 5/2007 | Nora et al. | 439/852 |
| 7,229,328 | B2 * | 6/2007 | Sawada et al. | 439/852 |
| 7,229,329 | B2 * | 6/2007 | Yamashita et al. | 439/852 |
| 7,252,561 | B2 * | 8/2007 | Nora et al. | 439/852 |
| 7,347,747 | B2 * | 3/2008 | Shimizu | 439/852 |
| 7,374,465 | B2 * | 5/2008 | Tanaka | 439/852 |
| 7,381,104 | B2 * | 6/2008 | Rehbein et al. | 439/852 |
| 7,387,550 | B2 * | 6/2008 | Myer et al. | 439/852 |
| 7,419,411 | B2 * | 9/2008 | Kaneko | 439/852 |
| 7,458,864 | B2 * | 12/2008 | Philipp | 439/851 |
| 7,485,016 | B2 * | 2/2009 | Ishigami | 439/851 |
| 7,513,806 | B2 * | 4/2009 | Noda et al. | 439/852 |
| 7,530,859 | B2 * | 5/2009 | Moll et al. | 439/852 |
| 7,785,160 | B2 * | 8/2010 | Shimizu | 439/852 |
| 7,938,695 | B2 * | 5/2011 | Furutani et al. | 439/852 |
| 7,950,972 | B1 * | 5/2011 | Chen et al. | 439/852 |
| 7,985,106 | B2 * | 7/2011 | Sugiyama et al. | 439/852 |
| 7,988,505 | B2 * | 8/2011 | Hotea et al. | 439/852 |
| 8,118,621 | B2 * | 2/2012 | Fukase | 439/852 |
| 8,206,187 | B2 * | 6/2012 | Nakamura et al. | 439/852 |
| 8,241,075 | B2 * | 8/2012 | Ishikawa et al. | 439/851 |
| 8,241,076 | B2 * | 8/2012 | Kubota | 439/852 |
| 8,323,061 | B2 * | 12/2012 | Hori | 439/852 |
| 8,333,622 | B2 * | 12/2012 | Blasko et al. | 439/852 |
| 8,371,883 | B2 * | 2/2013 | Kimura | 439/852 |

(Continued)

*Primary Examiner* — Ross Gushi
(74) *Attorney, Agent, or Firm* — Lawrence D Hazelton

(57) ABSTRACT

A low insertion force female terminal that is configured to make electrical contact with a male pin. The terminal includes a spring portion configured to be deflected by the pin as the pin is inserted into the terminal. The spring portion is also configured to urge a contact feature formed into the spring portion toward the pin to make electrical contact with the pin. The contact feature is characterized by an asymmetrical shape configured so a leading-edge ramp angle of the contact feature is less than a trailing-edge ramp angle of the contact feature. The asymmetrical shape reduces the peak insertion force for the terminal when compared to terminal designs that have symmetrically shaped contact features with similar dimensions.

4 Claims, 5 Drawing Sheets

(56) References Cited

U.S. PATENT DOCUMENTS

| | | | | |
|---|---|---|---|---|
| 8,454,394 | B2 * | 6/2013 | Iihoshi | 439/852 |
| 8,523,619 | B2 * | 9/2013 | Itou et al. | 439/852 |
| 8,662,935 | B2 * | 3/2014 | Jouas et al. | 439/660 |
| 8,784,144 | B2 * | 7/2014 | Hirabayashi et al. | 439/852 |
| 8,821,197 | B2 * | 9/2014 | Muro | 439/852 |
| 8,827,756 | B2 * | 9/2014 | Mueller | 439/852 |
| 8,944,861 | B2 * | 2/2015 | Amano et al. | 439/852 |
| 8,974,256 | B2 * | 3/2015 | Okano et al. | 439/852 |
| 2001/0002350 | A1 * | 5/2001 | Kashiyama et al. | 439/848 |
| 2003/0224668 | A1 * | 12/2003 | Matsuda | 439/839 |
| 2004/0224573 | A1 * | 11/2004 | Yoshida et al. | 439/852 |
| 2005/0112958 | A1 * | 5/2005 | Yagi et al. | 439/852 |
| 2008/0070452 | A1 * | 3/2008 | Komiyama et al. | 439/852 |
| 2010/0029146 | A1 * | 2/2010 | Myer et al. | 439/852 |
| 2010/0130075 | A1 * | 5/2010 | Casses et al. | 439/852 |
| 2010/0197177 | A1 * | 8/2010 | Myer et al. | 439/852 |
| 2012/0252283 | A1 * | 10/2012 | Muro | 439/839 |
| 2012/0289100 | A1 * | 11/2012 | Ishida | 439/858 |
| 2013/0288548 | A1 * | 10/2013 | Amano et al. | 439/852 |
| 2014/0287634 | A1 * | 9/2014 | Tsuji et al. | 439/852 |
| 2014/0287635 | A1 * | 9/2014 | Tsuji et al. | 439/852 |
| 2015/0087192 | A1 * | 3/2015 | Tanigawa et al. | 439/852 |

* cited by examiner

LOW INSERTION FORCE TERMINAL

TECHNICAL FIELD OF INVENTION

This disclosure generally relates to a low insertion force female terminal, and more particularly relates to a contact feature with an asymmetrical shape configured so a leading-edge ramp angle of the contact feature is less than a trailing-edge ramp angle of the contact feature

BACKGROUND OF INVENTION

For ergonomic reasons, it is desirable to minimize the force necessary to connect electrical connectors. As the pin count or terminal count of electrical connectors increases, minimizing the insertion force associated with each pin-to-terminal connection of the electrical connector becomes more important.

SUMMARY OF THE INVENTION

In accordance with one embodiment, a low insertion force female terminal is provided. The terminal is configured to make electrical contact with a male pin. The terminal includes a spring portion configured to be deflected by the pin as the pin is inserted into the terminal. The spring portion is also configured to urge a contact feature formed into the spring portion toward the pin to make electrical contact with the pin. The contact feature is characterized by an asymmetrical shape configured so a leading-edge ramp angle of the contact feature is less than a trailing-edge ramp angle of the contact feature.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
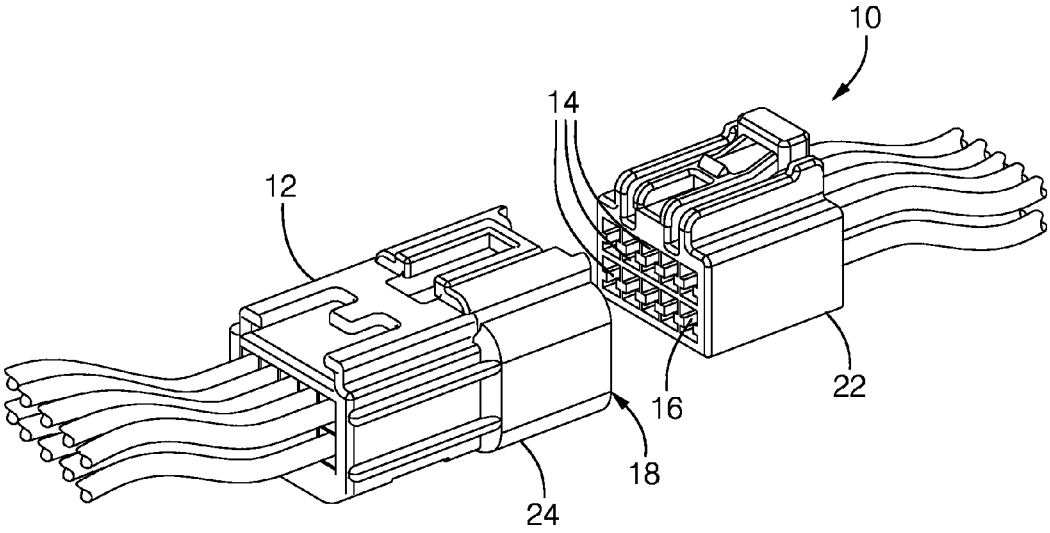
FIG. 1 is a perspective view of a connector assembly equipped with a low insertion force female terminal in accordance with one embodiment.

FIG. 1 illustrates a non-limiting example of a connector assembly 10 configured to form an electrical connection with a mating connector 12. The connector assembly 10 is typically configured to define a plurality of cavities 14, and each cavity is preferably equipped with a low insertion force female terminal, hereafter referred to as the terminal 16. In general, the terminal 16 is configured to make electrical contact with a male pin (hereafter the pin 18, see FIG. 2) which is installed in the mating connector 12. As will be explained in more detail in the description that follows, the terminal 16 described herein has features that provide for a reduced insertion force necessary to insert the pin 18 into the terminal 16 when compared to terminals described in the prior art.

Figure 2:
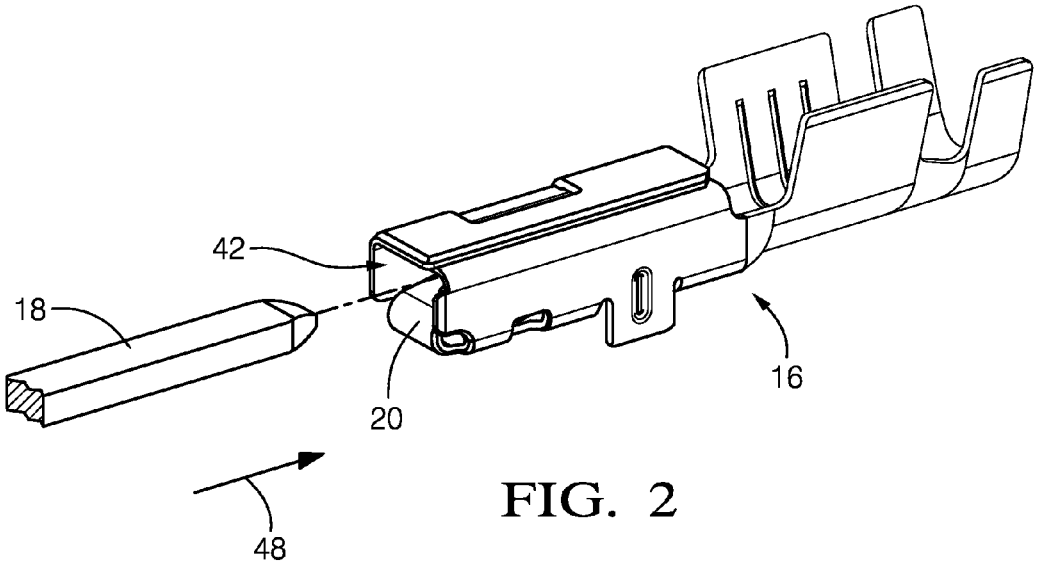
FIG. 2 is a perspective view of the terminal of FIG. 1 in accordance with one embodiment.

FIG. 2 further illustrates a non-limiting example of the terminal 16 and the pin 18 without (i.e. removed from) the connector housings 22, 24 shown in FIG. 1. The terminal 16 includes a spring portion 20 configured to be deflected by the pin 18 as the pin is inserted into the terminal 16. The spring portion 20 is generally configured to press or urge a contact feature 26 toward and against the pin 18 after the pin 18 is inserted into the terminal 16 in order to maintain electrical contact between the terminal 16 and the pin 18.

Figure 3A:
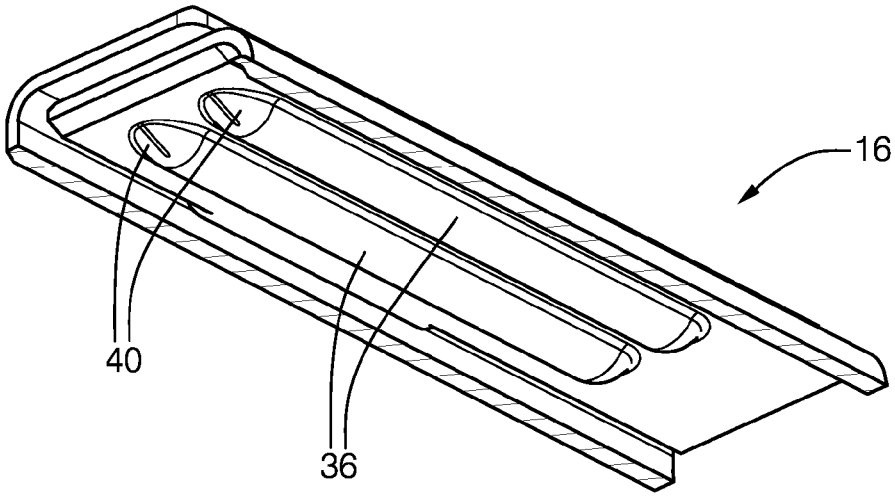
FIGS. 3A and 3B are perspective sectional views of the terminal of FIG. 1 in accordance with one embodiment.
Figure 3B:
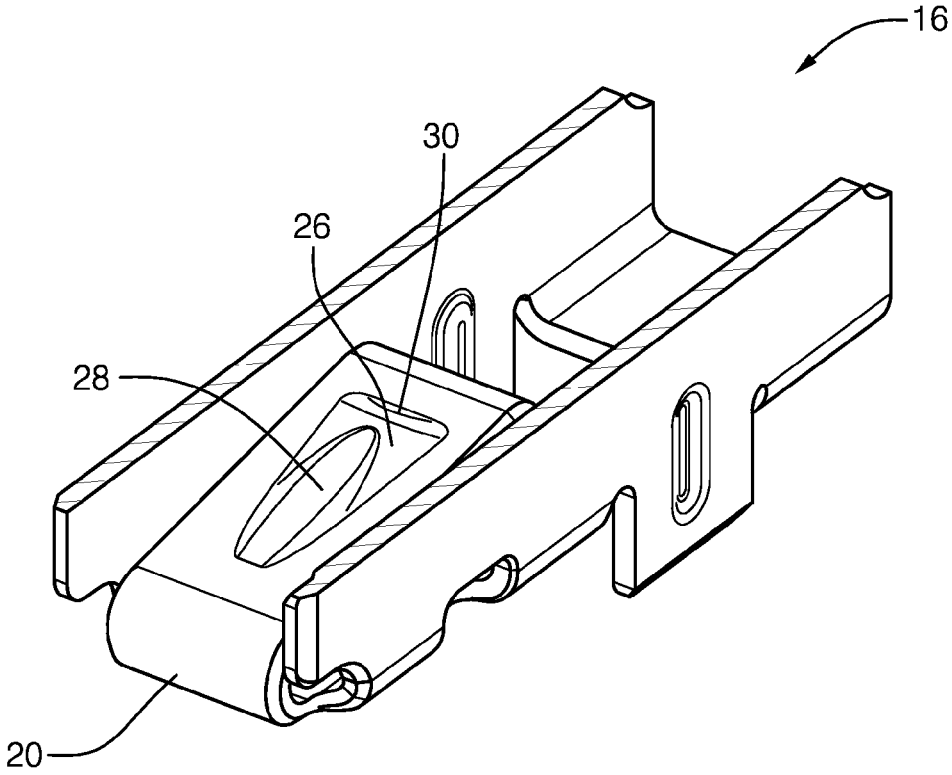

FIGS. 3A and 3B further illustrates a non-limiting example of the terminal 16. FIG. 3A shows an inside view of an upper portion of the terminal 16 from below the upper portion, and FIG. 3B shows an inside view of a lower portion of the terminal 16 from above of the lower portion. The spring portion 20 includes a contact feature 26 formed into the spring portion 20 that swells out upwardly from the spring portion 20. The spring portion 20 is configured to urge the contact feature 26 toward the pin 18 to make electrical contact with the pin 18. The contact feature 26 is advantageous as the urging force provided by the spring portion 20 is concentrated over a smaller area by the contact feature 26 than would be the case if the spring portion was unformed (i.e. generally flat) so a larger area of the spring portion 20 was in contact with the pin 18. Increased contact pressure (force per unit area) is desirable as the risk intermittent or unreliable electrical contact due to fretting corrosion and/or vibration is less likely.

The contact feature 26 described herein is an improvement over the prior art as it is characterized by an asymmetrical shape relative to the length of the pin 18. The asymmetrical shape may be characterized as being configured so a leading-edge ramp angle 28 of the contact feature 26 is less than a trailing-edge ramp angle 30 of the contact feature 26. As will be explained in more detail below, having the asymmetrical shape shown decreases the peak insertion force necessary to insert the pin 18 into the terminal 16 because the leading-edge ramp angle 28 is less than prior art examples which have a symmetrical shape. U.S. Pat. No. 6,506,084 issued Jan. 14, 2003 to Saitoh illustrates a contact feature that, from a side view, is relatively symmetric. As will be shown in the description below, a contact feature shaped according to Saitoh's illustrations leads to increased insertion force when compared to the contact feature 26 described herein.

It should be recognized that the height and size (area) of the contact features shown here and in the prior art are presumed to be comparable. It is recognized that increasing the area or decreasing the height are other ways to decrease the leading edge angle and thereby decrease the insertion force. However, as the size of the terminal 16 is a limiting feature, the area of the contacting feature is typically made as large as feasible.

Figure 4:
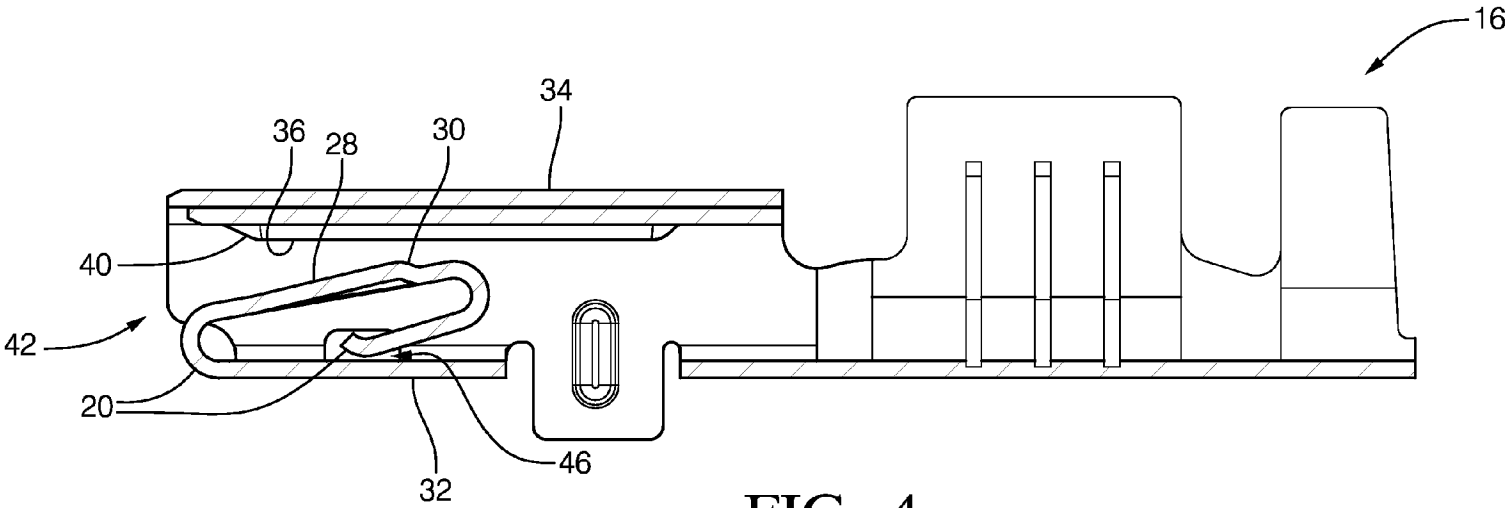
FIG. 4 is a sectional side view of the terminal of FIG. 1 in accordance with one embodiment.

FIG. 4 further illustrates a non-limiting example of the terminal 16. In this example, the spring portion 20 is located on a bottom side 32 of the terminal, and the terminal 16 includes a fixed-rail portion 36 located on a top side 34 of terminal 16. The fixed-rail portion 36 is advantageous as it generally reduces the contact area of the terminal 16 to the pin 18 thereby increasing the contact pressure as compared to a configuration where a broader contact area between the pin 18 and the top side 34 of the terminal 16 exists. Increased contact pressure (force per unit area) is desirable as the risk intermittent or unreliable electrical contact due to fretting corrosion or vibration is less likely, as previously noted.

As shown in FIG. 3A, the terminal 16 in these non-limiting examples has two fixed rails symmetrically arranged about, and parallel to, a midline of the terminal 16. This arrangement is preferred so a triangle support of the pin 18 is formed. That is, the contact feature 26 is generally configured to make contact with the pin 18 along the midline of the terminal 16, while the two fixed rails are spaced apart approximately equal distance from the midline to secure the pin 18 in a manner that better resists twisting of the pin 18 within the terminal 16.

Continuing to refer to FIG. 4, the fixed-rail portion 36 may include a ramp feature 40 configured to guide the pin 18 into the terminal 16. The ramp feature 40 is advantageous if the pin 18 is not perfectly aligned with the terminal 16 when initially inserting the pin 18 into the terminal 16.

Figure 5:
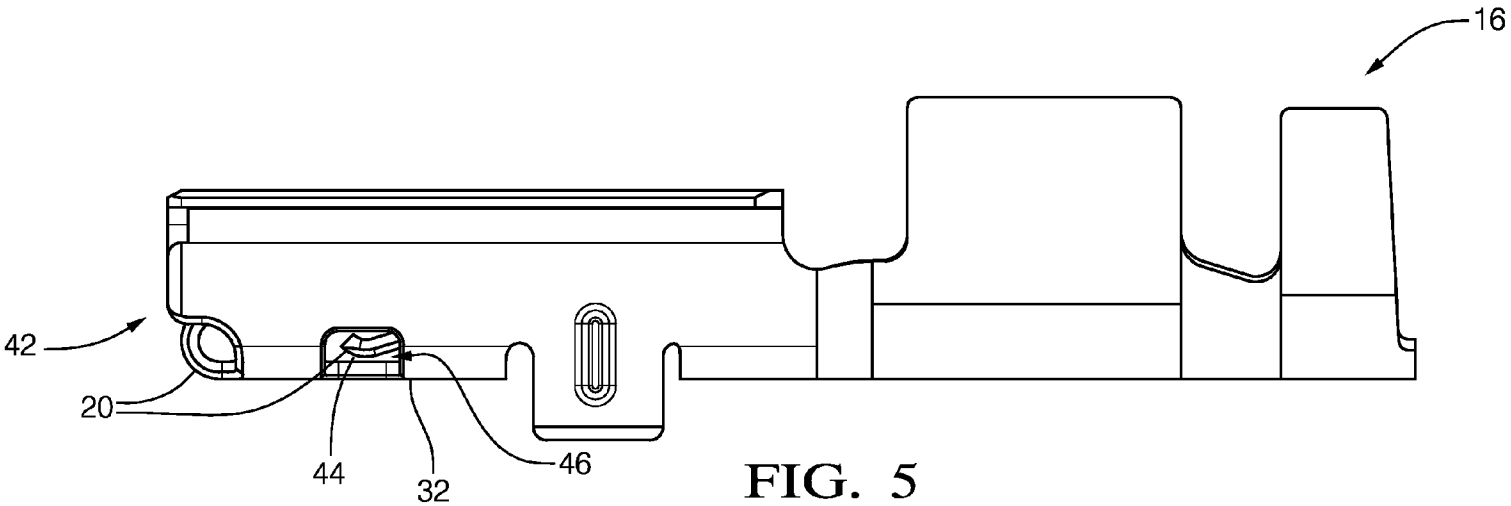
FIG. 5 is a side view of the terminal of FIG. 1 in accordance with one embodiment.

FIGS. 4 and 5 further illustrate how the terminal 16 is configured to define a box 42 into which the pin 18 is inserted. The walls of the box 42 define an opening 44 through which a gap 46 between the spring portion 20 and a bottom side 32 of the terminal can be observed. The opening 44 is useful during manufacturing or fabrication of the terminal 16 as a means to control the contact force that the spring portion 20 provides to urge the contact feature 26 against the pin 18. If the gap is too small, then the engage force and contact (normal) force may be greater than desired. If the gap is too large, then the engage force and contact force may be less than desired.

Figure 6A:
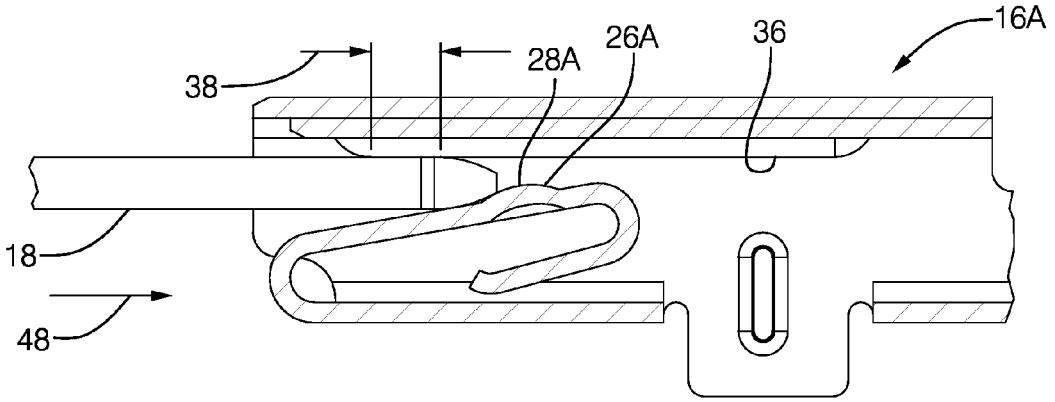
FIGS. 6A and 6B are sectional side views of alternative terminal in accordance with one embodiment.
Figure 7A:
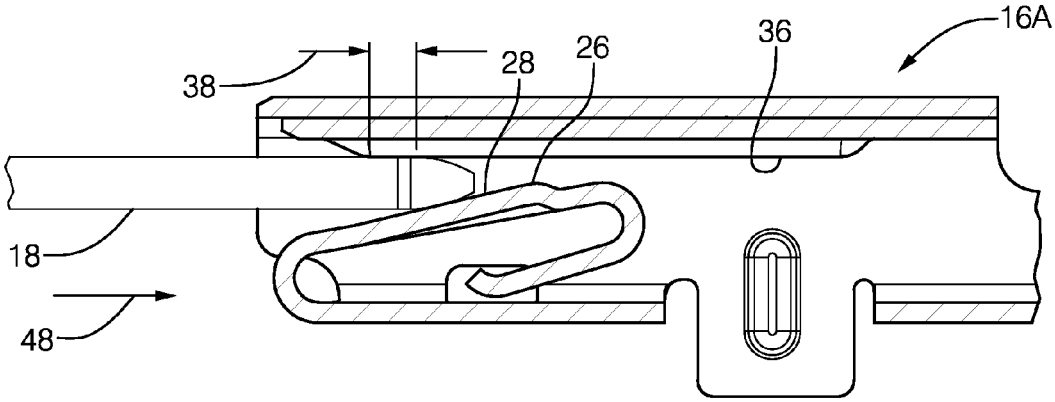
FIGS. 7A and 7B are sectional side views of the terminal of FIG. 1 in accordance with one embodiment.

FIGS. 6A and 7A further illustrate how the terminal 16 is further configured so the pin 18 overlaps the fixed-rail portion 36 a lead-in distance 38 before the spring portion 20 is deflected as the pin 18 is inserted into the terminal 16. Such an arrangement is advantageous so the pin 18 has established a parallel sliding contact with the fixed rail portion 36 before making contact with the spring portion 20. This configuration stands in contrast to the illustrations shown by Saitoh (U.S. Pat. No. 6,506,084) where the pin contacts the spring feature before, or at the same instant as, the pin contacts the fixed rail portion. Because the lead-in ramp angle of Saitoh is greater, and because the pin may be deflected by the fixed-rail portion of Saitoh at the same time the pin is deflecting the spring portion, Saitoh experiences higher insertion forces.

Figure 6B:
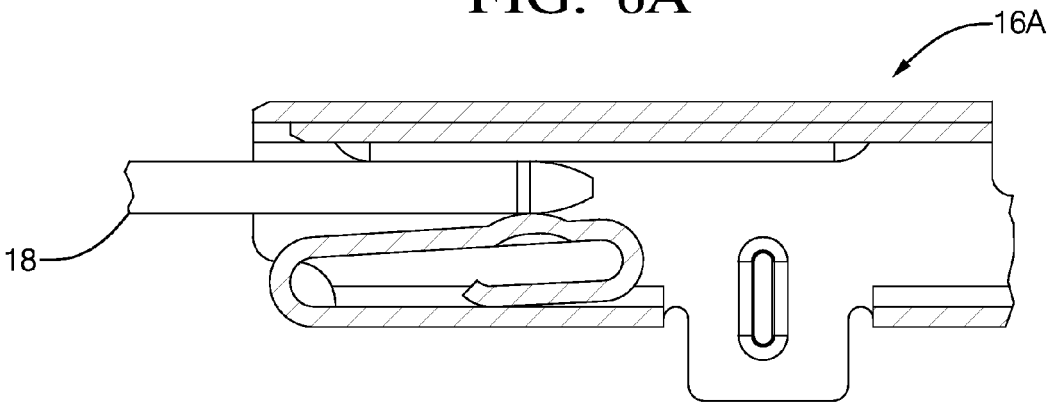
Figure 7B:
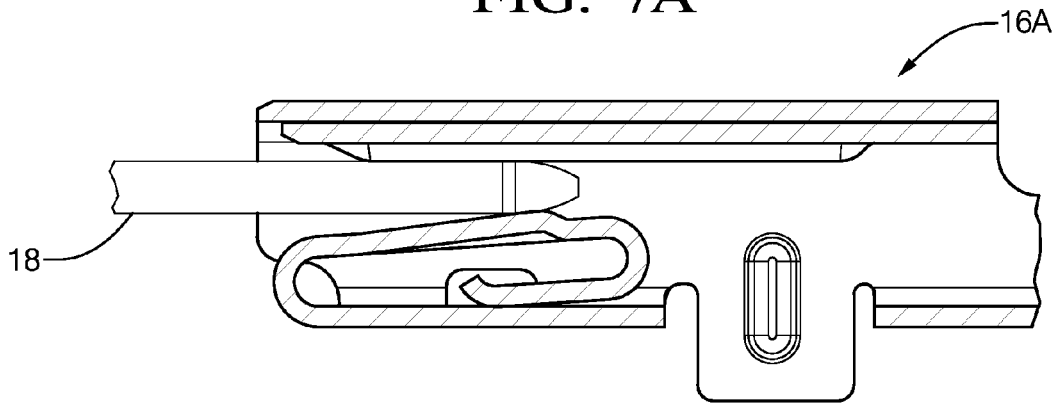

FIGS. 6A and 6B illustrate a terminal 16A that is comparable to the terminal 16 shown in FIGS. 7A and 7B. It should be recognized that the terminal 16A has a contact feature 26A that is generally characterized as symmetrical, and so the leading-edge ramp angle 28A shown in FIG. 6A has a greater angle than the leading-edge ramp angle 28 shown in FIG. 7A relative to the direction of travel 48 of the pin 18.

Figure 6C:
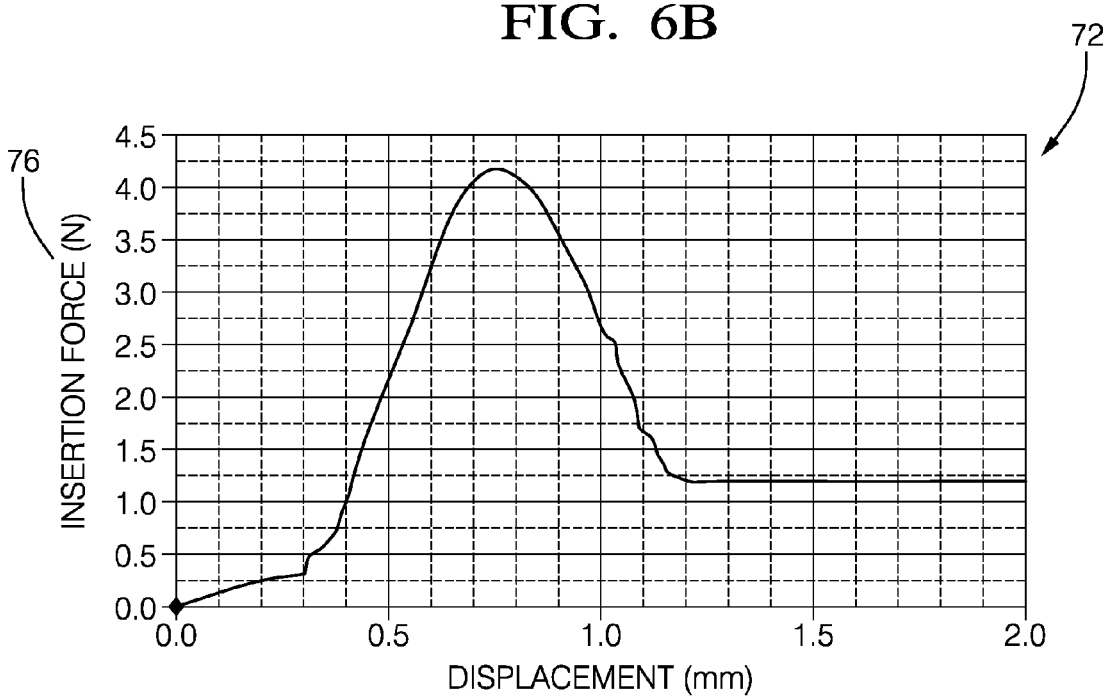
FIG. 6C is a graph of an insertion force characteristic of the terminal of FIGS. 6A and 6B in accordance with one embodiment.
Figure 7C:
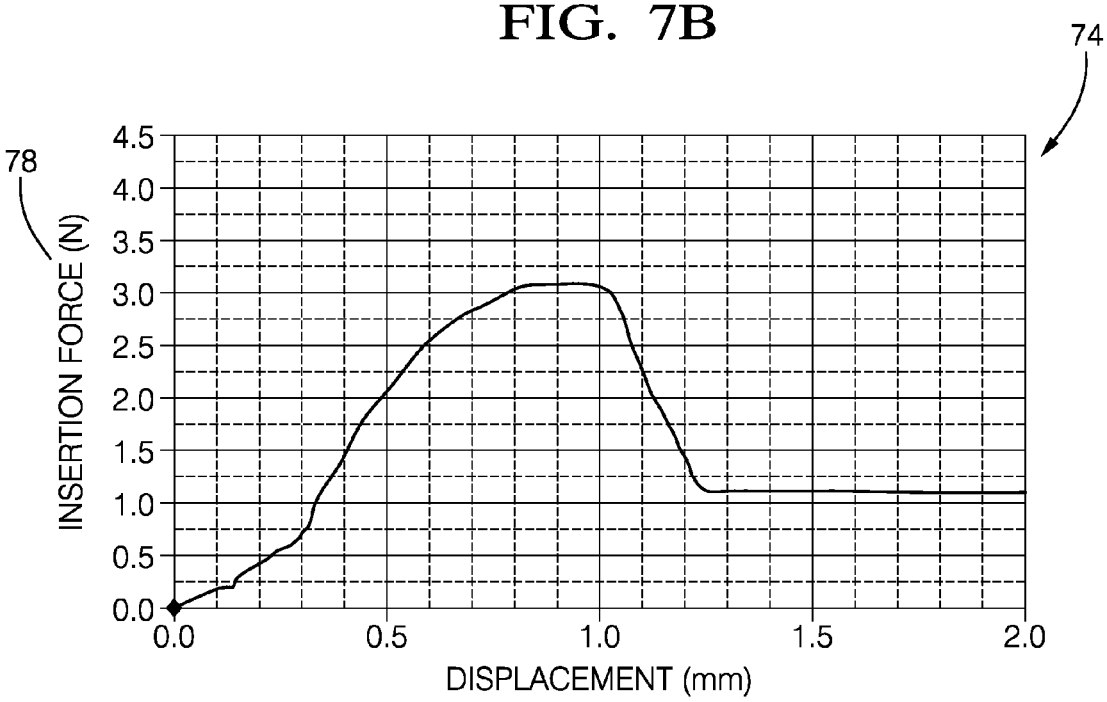
FIG. 7C is a graph of an insertion force characteristic of the terminal of FIGS. 7A and 7B in accordance with one embodiment.

FIGS. 6C and 7C illustrate graphs 72, 74, respectively, that tabulate data of insertion force 76, 78 necessary to advance the pin 18 into the terminal 16A or 16. FIGS. 6A and 7A correspond to displacements of 0.30 mm on the graphs 72, 74, respectively. FIGS. 6B and 7B correspond to displacements 0.77 mm and 0.90 mm on the graphs 72, 74, respectively. As can be seen from the graphs 72, 74, the peak force required to advance the pin 18 into the terminal 16A shown in FIGS. 6A and 6B is a little over four Newton (4N). In contrast, the peak force required to advance the pin 18 into the terminal 16 shown in FIGS. 7A and 7B (and FIG. 4), which incorporates the improvement of the contact feature 26 described herein is about three Newton (3N). As such, using the terminal 16 for a connector assembly 10 reduces the peak insertion force by about 25% when compared to a connector assembly that uses the terminal 16A.

Accordingly, a low insertion force female terminal (the terminal 16) is provided. The asymmetrical shape of the contact feature 26 allow for the leading-edge ramp angle 28 to be reduced when compared to prior art examples such as the contact feature 26A which has a symmetrical shape. The terminal 16 is also configured so the pin is in parallel sliding contact with the terminal 16 so the insertion force is not required to simultaneously deflect the pin 18 into the box 42 and deflect the spring portion 20. In other words, the peak effective deflection angle is reduced and spread out over a greater distance which thereby reduces the peak insertion force needed to advance the pin 18 into the terminal 16.

While this invention has been described in terms of the preferred embodiments thereof, it is not intended to be so limited, but rather only to the extent set forth in the claims that follow.

We claim:

1. A low insertion force female terminal configured to make electrical contact with a male pin, said terminal comprising:

a spring portion configured to be deflected by the pin as the pin is inserted into the terminal, wherein the spring portion includes a contact feature formed in to the spring portion that swells out upwardly from an unformed portion of the spring portion, said spring portion configured to urge the contact feature formed into the spring portion toward the pin to make electrical contact with the pin, wherein the contact feature is characterized by an asymmetrical shape configured so, measured relative to the unformed portion, a leading-edge ramp angle of the contact feature is less than a trailing-edge ramp angle of the contact feature, wherein the spring portion is located on a bottom side of the terminal, and the terminal includes a fixed-rail portion located on a top side of terminal, wherein the fixed rail portion includes two fixed rails symmetrically arranged about, and parallel to, a midline of the terminal.

2. The terminal in accordance with claim 1, wherein the terminal is configured so the pin overlaps the fixed-rail portion a lead-in distance before the spring portion is deflected as the pin is inserted into the terminal.

3. The terminal in accordance with claim 1, wherein the fixed-rail portion includes a ramp feature configured to guide the pin into the terminal.

4. The terminal in accordance with claim 1, wherein the terminal is configured to define a box into which the pin is inserted, wherein the box defines an opening through which a gap between the spring portion and a bottom side of the terminal can be observed.

* * * * *